US008869487B2

(12) United States Patent
Haintze et al.

(10) Patent No.: US 8,869,487 B2
(45) Date of Patent: Oct. 28, 2014

(54) SYSTEM OF CONSTRUCTION ELEMENTS FOR THE DRY CONSTRUCTION OF STRUCTURES

(75) Inventors: Jerzy Haintze, Warsaw (PL); Andrzej Haintze, Lomianki (PL)

(73) Assignee: HCH Spólka z o.o., Warszawa (PL)

( * ) Notice: Subject to any disclaimer, the term of this patent is extended or adjusted under 35 U.S.C. 154(b) by 0 days.

(21) Appl. No.: 13/811,842

(22) PCT Filed: Jun. 21, 2011

(86) PCT No.: PCT/PL2011/000061

§ 371 (c)(1),
(2), (4) Date: Jan. 23, 2013

(87) PCT Pub. No.: WO2012/018270

PCT Pub. Date: Feb. 9, 2012

(65) Prior Publication Data

US 2013/0118109 A1 May 16, 2013

(30) Foreign Application Priority Data

Aug. 3, 2010 (PL) ..... 392053

(51) Int. Cl.

| | |
|---|---|
| ***E04B 1/61*** | (2006.01) |
| ***E04B 7/20*** | (2006.01) |
| ***E04B 5/08*** | (2006.01) |
| ***E04B 2/08*** | (2006.01) |
| ***E04C 1/00*** | (2006.01) |
| *E04B 2/02* | (2006.01) |

(52) U.S. Cl.

CPC ..... *E04C 1/00* (2013.01); *E04B 2002/0208* (2013.01); *E04B 7/20* (2013.01); *E04B 5/08* (2013.01); *E04B 2/08* (2013.01); *E04B 2002/0217* (2013.01); *E04B 2002/023* (2013.01)

USPC ..... 52/605; 52/591.1; 52/603; 52/608; 52/762; 52/763

(58) Field of Classification Search

CPC ..... E04B 2/08; E04B 2/42; E04B 2002/0295; E04B 2/20; E04B 2/12; E04B 2/44; E04D 1/04

USPC ..... 52/479, 482, 483.1, 578, 581, 582.1, 52/584.1, 586.1, 586.2, 588.1, 589.1, 52/591.1, 592.1, 596, 598, 59, 603, 604, 52/605, 608, 609, 772, 775, 777, 778, 779, 52/780, 781.5, 762, 763, 764, 766

See application file for complete search history.

(56) References Cited

U.S. PATENT DOCUMENTS 468,838 A * 2/1892 Steiger ..... 52/284
1,592,476 A * 7/1926 Torrecelli ..... 52/125.3

(Continued)

FOREIGN PATENT DOCUMENTS

DE 2435735 A1 * 2/1976
DE 19502979 A1 8/1996

(Continued)

*Primary Examiner* — Charles A Fox
*Assistant Examiner* — Joseph J Sadlon
(74) *Attorney, Agent, or Firm* — Christopher L. Parmelee; Walker & Jocke

(57) ABSTRACT

This invention concerns a system of construction elements for the dry construction of a structure by way of shaped protrusions for mutual connection during assembly. It consists of construction element modules for raising walls, the ceiling and roof, and that the module consists of two elements with adjacent sides connected by a third element, creating a self-tightening connection, and the shaped protrusions of construction elements have two lateral contact surfaces, guiding (1) and self-tightening (2), inclined at specific angles α and β, and these angles are determined, respectively, between the perpendicular to the upper or lower protrusion surface and the guiding or self-tightening surface. The invention also includes applications of the specified system for raising compact and low structures, as well as for completing walls in buildings with skeletal constructions, and also as a block system for raising miniature constructions.

11 Claims, 11 Drawing Sheets

(56) References Cited

U.S. PATENT DOCUMENTS

Figure 1:
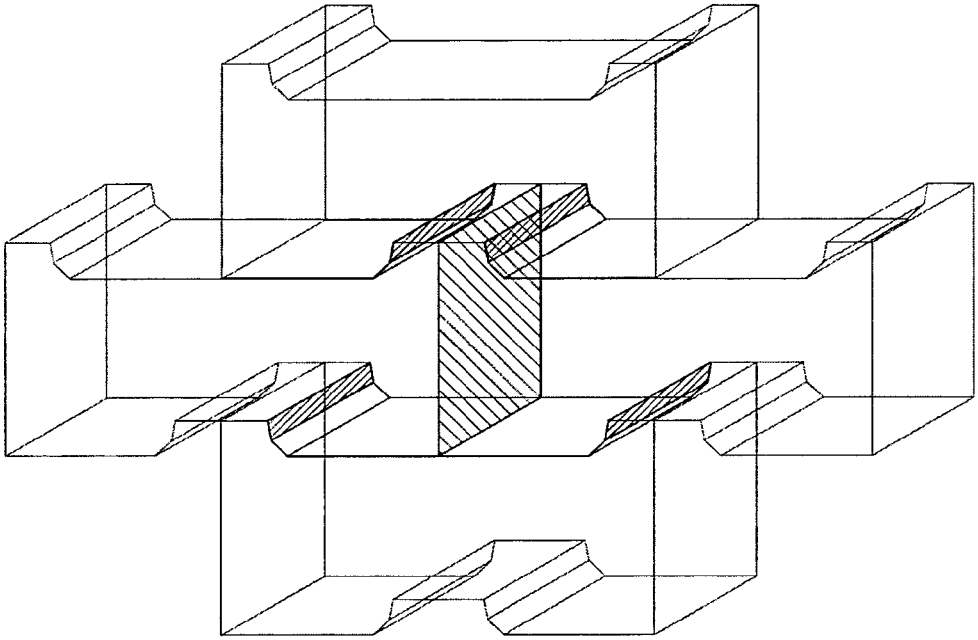

| | | | | | |
|---|---|---|---|---|---|
| 1,721,596 | A | * | 7/1929 | Himmel et al. | 52/204.57 |
| 1,939,528 | A | * | 12/1933 | Swift | 52/448 |
| 2,142,305 | A | * | 1/1939 | Davis | 52/592.1 |
| 2,793,022 | A | * | 5/1957 | Harris | 165/9.1 |
| 3,418,774 | A | * | 12/1968 | Kocher et al. | 52/437 |
| 3,759,043 | A | * | 9/1973 | Tokunaga | 249/102 |
| 4,155,206 | A | * | 5/1979 | Player | 52/200 |
| 4,485,604 | A | * | 12/1984 | Palamara et al. | 52/436 |
| 4,765,103 | A | * | 8/1988 | Clarke | 52/86 |
| 5,685,119 | A | | 11/1997 | Zschoppe | |
| 5,687,531 | A | * | 11/1997 | Nelson et al. | 110/338 |
| 5,802,797 | A | * | 9/1998 | Storer-Folt | 52/604 |
| 6,223,493 | B1 | * | 5/2001 | Ruggeri | 52/592.6 |
| 6,494,013 | B2 | * | 12/2002 | Winskye | 52/745.01 |
| 6,665,994 | B1 | * | 12/2003 | Ruggeri | 52/592.6 |
| 6,705,797 | B1 | * | 3/2004 | Wada | 404/38 |
| 6,782,673 | B2 | * | 8/2004 | Azar | 52/604 |
| RE39,922 | E | * | 11/2007 | Rainey | 405/262 |
| 7,497,646 | B2 | * | 3/2009 | Price | 405/284 |
| 8,397,461 | B2 | * | 3/2013 | Browning et al. | 52/588.1 |
| 8,443,566 | B2 | * | 5/2013 | Wennberg | 52/589.1 |
| 2004/0035079 | A1 | * | 2/2004 | Evjen | 52/592.1 |
| 2004/0074189 | A1 | * | 4/2004 | Deschenes | 52/589.1 |
| 2006/0156666 | A1 | * | 7/2006 | Caufield | 52/483.1 |
| 2007/0175150 | A1 | * | 8/2007 | Price | 52/483.1 |
| 2010/0018147 | A1 | * | 1/2010 | Du | 52/506.05 |
| 2010/0205886 | A1 | * | 8/2010 | Carbines | 52/478 |
| 2013/0149033 | A1 | * | 6/2013 | Rainey | 404/6 |

FOREIGN PATENT DOCUMENTS

| | | | | | |
|---|---|---|---|---|---|
| DE | 19508383 | A1 | | 9/1996 | |
| EP | 0490168 | A1 | | 6/1992 | |
| EP | 0872607 | A2 | | 10/1998 | |
| FO | 2221036 | A5 | | 10/1974 | |
| FR | 1033385 | A | * | 7/1953 | |
| FR | 1222956 | A | * | 6/1960 | |
| FR | 2221036 | A | * | 11/1974 | |
| FR | 2384077 | A1 | | 10/1978 | |
| PL | 290398 | A2 | | 3/1992 | |
| PL | 292616 | A1 | | 8/1992 | |
| PT | 78808 | B | * | 7/1986 | |
| WO | WO 8102983 | A1 | * | 10/1981 | A63H 33/08 |
| WO | WO 02090677 | A2 | * | 11/2002 | |
| WO | 03104580 | A1 | | 12/2003 | |
| WO | WO 2006074538 | A1 | * | 7/2006 | B28B 7/00 |

* cited by examiner

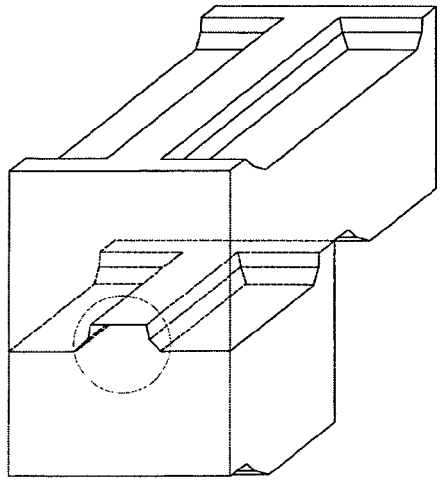
fig 30
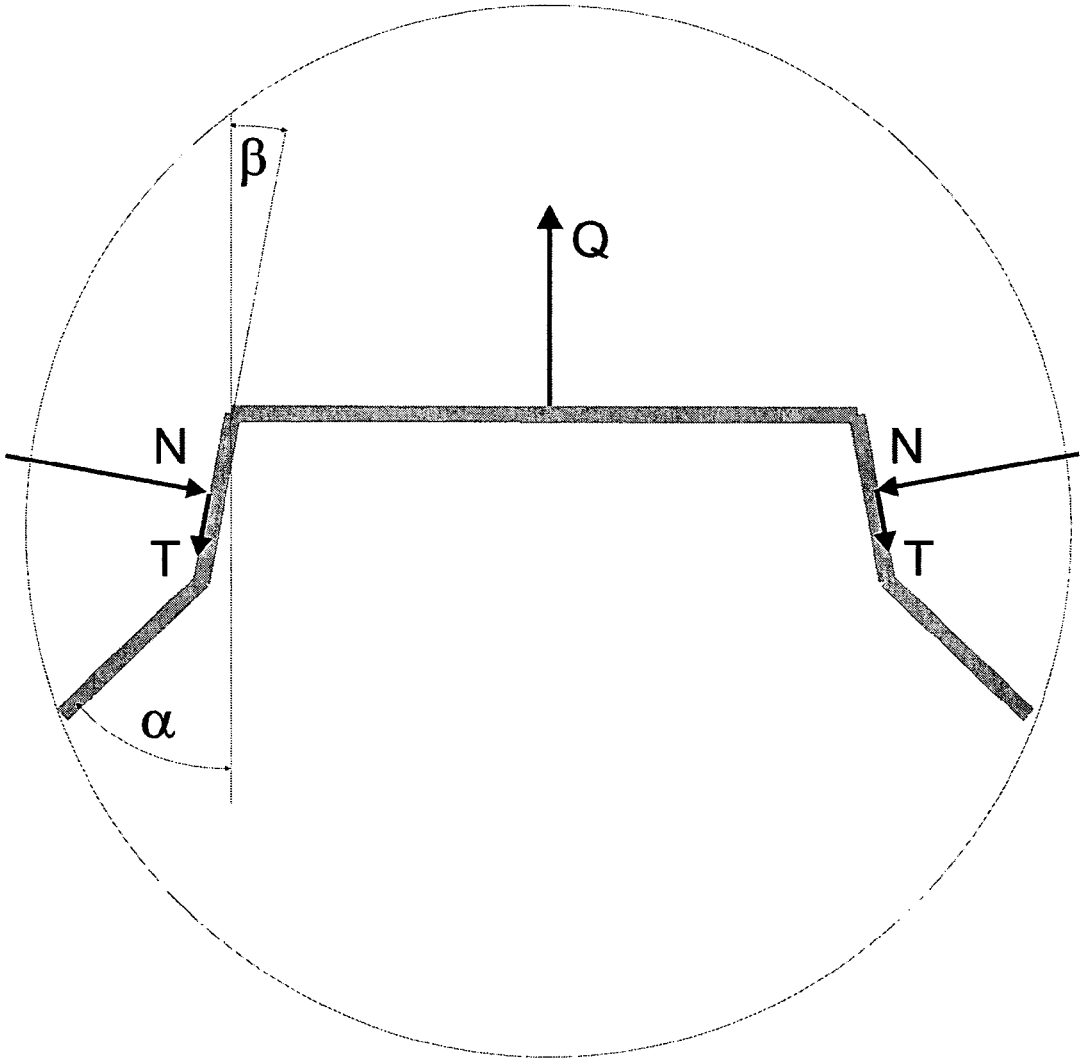

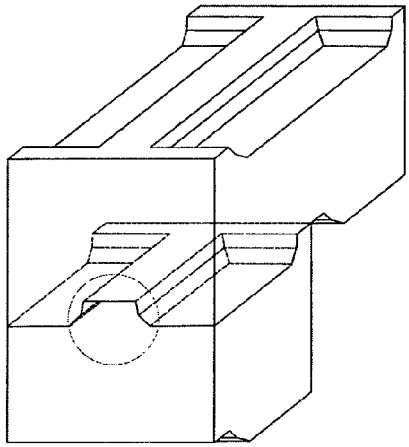
fig 31
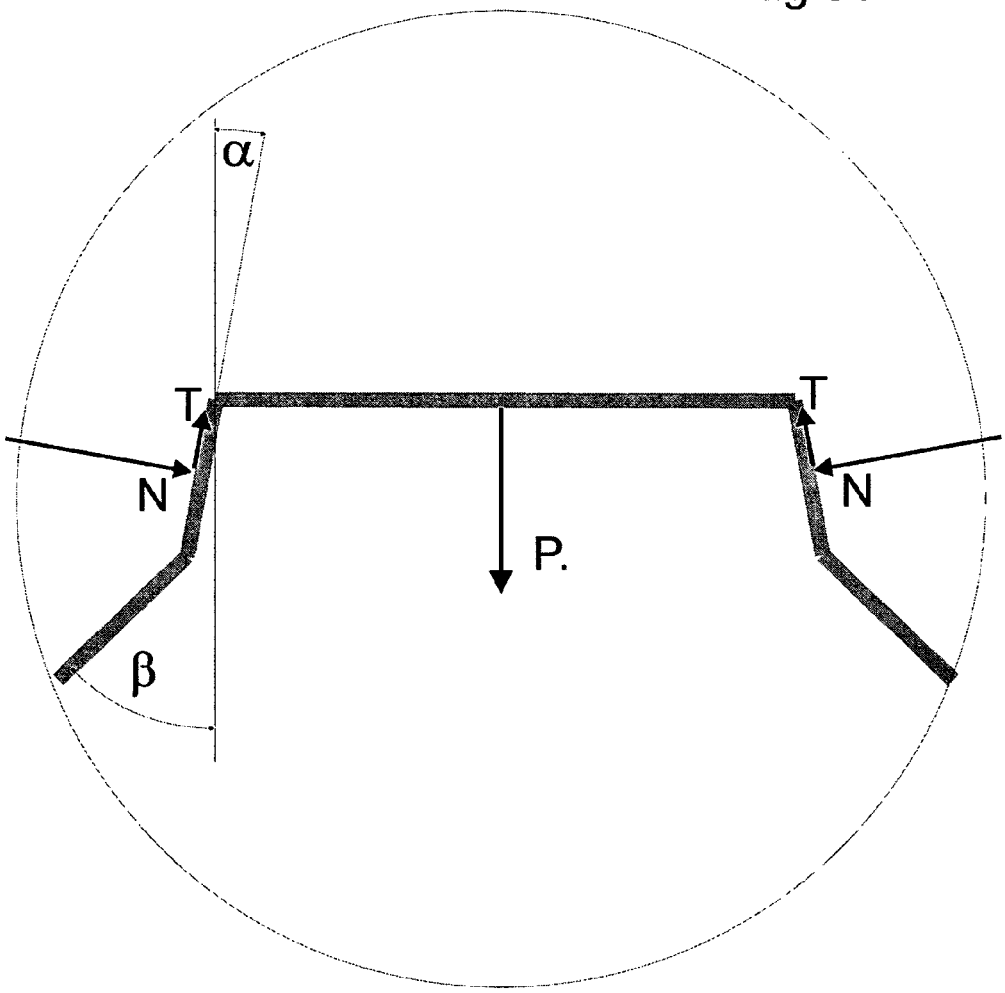

SYSTEM OF CONSTRUCTION ELEMENTS FOR THE DRY CONSTRUCTION OF STRUCTURES

This invention concerns a system of construction elements for the dry construction of structures.

Construction elements for the dry construction of masonry, eliminating wet techniques, are known. A construction element in the form of a body for the dry placement of masonry with an approximate shape of a rectangle or square in a horizontal projection has been described in Polish patent application P-292616. At least one raised area in the shape of a frame is present on the upper side of this element, upon which a construction element with recesses corresponding to the raised areas is placed.

Another solution described in Polish patent application P-290398 presents a method for raising walls from gypsum blocks as well as a block for raising walls without the use of binding material. The block has the shape of a rectangular prism with conical protrusions on its upper surface and conical recesses on its lower surface, where the cones on both surfaces have a shared axis of symmetry.

The construction elements create systems for the construction of structures. One such system of elements for wall construction can be found in German patent application DE 195 02 979. This system includes elements that can be connected using a dry method. One contact surface of the element has a recess, while the other surface has a protrusion matching this recess.

Another solution is a construction element with cooperating elements and at least one hollow passage described in German patent application DE 195 08 383. The elements indicated in this document possess interlocking surfaces that make shifting impossible in the direction of the wall being raised as well as in a direction perpendicular to the wall. The interlocking elements were made as a protrusion and groove, which cross on locking faces and, in particular, lie at a straight angle relative to each other. The construction element described in this solution can be used for dry construction.

Another construction element, described in European patent application EP 0 872 607, possesses mutually complementing connecting elements on its upper and lower surfaces, which create protrusions on the upper surface and recesses on the lower surface. These recesses and protrusions have a trapezoidal cross-section. Connecting elements in the lengthwise direction are parallel to the longer sides. The width of these elements comprises ⅓ the width of the shorter sides. They can be placed in the central part of the shorter sides. This solution refers to a dry-built wall made from construction elements, but with the use of braces to tie individual elements together.

The construction elements described above have certain flaws in their technical state that result in difficulties in their practical implementation. For example, in the solution found in DE 195 08 383, the protrusions present on surfaces of the building element are easily damaged, which is related to significant problems with transport and large losses of material.

Furthermore, none of these solutions ensures full caulking when the gravitational load is placed on all contacting surfaces, which, especially in the case of curtain and load-bearing walls, is very significant.

The aim of this solution was to develop such a system of construction elements, the shape of which would make it ideally possible to lay down consecutive elements during the assembly of the structure and ensure a precise and lasting fix of these elements throughout the structure without the need for any mortar, adhesives or mechanical connecting elements.

Another aim was the development of a system of elements that could be assembled by lower qualified workers working only with appropriate supervision and also one that would make it possible for a home to be built by its future users without the need for heavy construction equipment.

These aims have been achieved thanks to the solution in this invention.

The system of construction elements for the dry construction of structures with block-type elements in the form of geometric bodies with protrusions on their surfaces is comprised of construction element modules for raising walls, the ceiling and the roof. A module is comprised of two elements with their sides adjacent to each other connected by a third element, creating a self-tightening joint whereby the shaped protrusions of the construction elements have two, guiding contact surfaces inclined at specific angles $\alpha$ and $\beta$, which are the guide surface and the self-tightening surface. The angles are determined, respectively, to the perpendicular of the upper or lower protrusions and the guiding or self-tightening surfaces.

In an advantageous solution, the angle of inclination $\alpha$ is within a range of 40°-50° and the angle $\beta$ is within a range of 6°-12°. In the most optimal solution, the angle of inclination $\alpha$ is equal to 45° and angle $\beta$ is equal to 7°.

In keeping with the invention, the system of construction elements has a protrusion composed of two adhering trapezoids, where the trapezoid with a smaller angle of inclination in the mutual connection of elements functions as a portion of a self-tightening wedge with a convergence angle of $2\alpha$.

The invention includes construction element modules for walls, the ceiling and roof.

The wall module construction element includes three parts possessing recesses and protrusions located on the upper and lower surfaces, creating a self-tightening connection. The system of recesses and protrusions on the lower surface is shifted by half the length of the construction element in relation to the system of recesses and protrusions on the upper surface. The side-guiding and self-tightening contact surfaces of the protrusions and recesses are inclined at specific angles $\alpha$ and $\beta$, in which the cross-section of protrusions and recesses has the shape of two trapezoids of a common base with one lying on top of the other. The sides of the lower trapezoid are inclined at angle $\alpha$, which is determined by the angle between the perpendicular to the lower protrusion surface and the guiding surface, and the sides of the upper trapezoid are inclined at an angle of $\beta$, which is determined by the angle between the perpendicular to the upper protrusion surface and the self-tightening surface.

The ceiling module construction element contains a basic and supplementary ceiling element as well as a ceiling beam. The basic and supplementary ceiling construction elements possess side contact surfaces, which are guiding and self-tightening and inclined at angles $\alpha$ and $\beta$, upon which self-tightening connections are formed. These surfaces are found on protrusions located near the upper edge of the adjacent basic and supplementary ceiling construction elements in which the side self-tightening contact surface creates angle $\beta$ with the perpendicular to the upper surface of the ceiling element, and the lateral guiding contact surface and the perpendicular to the lower surface of the ceiling construction element form angle $\alpha$. Basic and supplementary ceiling construction elements are alternately placed.

The roof module construction element includes a basic roof construction element and a supplementary roof element as well as a roof rafter beam. The basic and supplementary roof construction elements have protrusions located on their side surfaces and the roof rafter beam has recesses throughout its entire length. The guiding and self-tightening surfaces of recesses and protrusions create a self-tightening connection. Protrusions on the side surface of the basic roof construction element and the roof supplementary element constitute a mutual fitting of recesses on the roof rafter beam. Furthermore, recesses and protrusions are situated at an acute angle relative to the perpendicular to the roof surface. The guiding and self-tightening lateral contact surfaces of protrusions and recesses are inclined at specific angles $\alpha$ and $\beta$ while the side walls of the self-tightening part of protrusions and recesses are inclined at an angle of $\beta$ relative to the perpendicular of the lower surface of the protrusion and recess. The side walls of the guiding surfaces of recesses and protrusions are inclined at the acute angle $\alpha$ to the perpendicular of the lower surface of the protrusion and recess. Furthermore, the guiding surfaces of the protrusions and recesses are inclined at acute angle $\gamma$. Also the side walls of the protrusion and recess in the self-tightening and guiding part have different lengths. Basic roof construction elements and supplementary roof elements are alternately placed.

The system of construction elements for the dry construction of structures is meant for the raising of a compact and low structure as well as for the completion of walls in buildings with a skeletal structure. Furthermore, this system can be used as blocks for raising miniature constructions.

The self-tightening connections occurring between protrusions along the elements cause the presence of additional shear stresses distributed over these protrusions when tensile forces are present in the wall.

An advantage to this solution is the simplicity of designing structures with the application of highly advanced numerical techniques and the very quick, exceptionally precise and toolless execution of the designed structures without the use of wet techniques and with the possibility of utilizing industrial robots for production of the construction elements in a factory as well as at the construction site.

Another advantage of this solution by this invention is a lack of waste in the process of building structures. Thanks to this invention, the need for a high precision of assembly of individual system elements has been achieved, which significantly simplifies the effort of workers while simultaneously shortening the time of execution of the entire building task to even two weeks from the supply of materials to the construction site. This significantly decreases expenses sustained during construction work as well as during finishing work.

Thanks to the application of systems from this invention, it is possible for even lower qualified persons to raise structures without the use of heavy construction equipment, e.g., by lower qualified workers or by the future users of the structure.

Another distinguishing property of the system that makes it different from solutions known to this point is the fact that there is no possibility for a perfect fit of the upper surface of one element with the lower surface of another by placing the elements exactly on top of one another.

This system also includes construction elements for assembling window and door joints in full view during the raising of walls, without the need for additional fixings and sealants, which obviously shortens the assembly time and ensures greater heating comfort, resulting in lower expenditures for the user of the structure on heating/air conditioning.

All of these aspects undoubtedly lead to a decrease in unit costs of raised structures. This system also ensures, according to its assumptions, high design flexibility and interior planning as well as the possibility of building structures in areas prone to seismic activity. An additional advantage is the independence of the construction work from the time of year at any geographical latitude as well as from access to water that is necessary for the preparation of materials such as mortar.

According to this invention, one property distinguishing this ideal solution from other solutions is the fact that there are at least three cooperating elements, which unequivocally ensures a mutual connection that allows for the self-caulking of connections due to the presence of resultant stresses between neighbouring elements.

This caulking makes it possible to build very precise constructions without the necessity of executing further levelling work before executing the finishing layers. Caulking also causes an increase in the thermal and acoustic insulation of walls executed using the system according to the invention.

The high precision of making elements according to the invention and the module graduation equal to 30 cm allows for sufficiently arbitrary construction of buildings. Thanks to the appropriate computer software, it is possible to easily transpose any architectural design to a design using the system according to the invention. In addition, designing with this system allows for the immediate and precise specification of the demand for the amounts of individual elements necessary for the execution of the accepted building task. There is also no need to account for a material surplus for so-called "losses" that occur during the execution of masonry work using conventional methods.

The dimensions of the buildings after construction will have dimensions corresponding exactly to the dimensions designed by the architect. There is no need to check inventory after execution, which may be necessary for interior planning. The documentation for executing finishing work can be made at the design stage.

All of these system properties allow for a significant decrease in the price of the final product, the dwelling, through a significant shortening of the time of execution of the completed task.

The objects of the invention are presented in examples in drawings, in which

Figure 2:
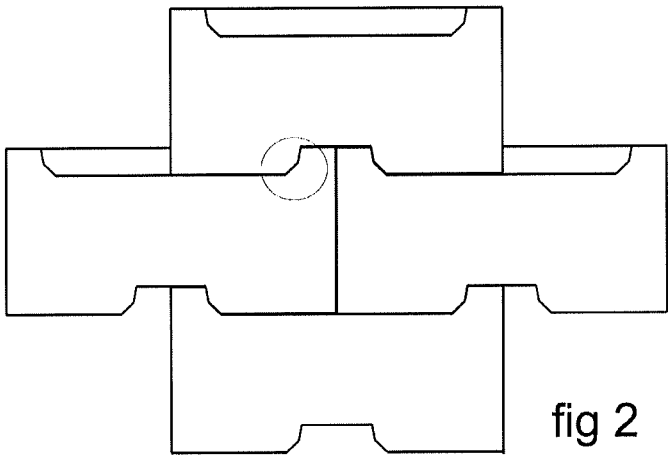
Figure 3:
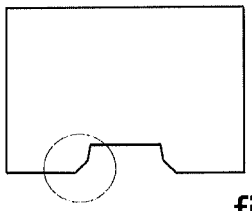
Figure 4:
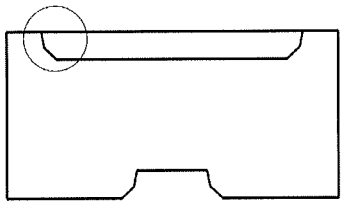
Figure 5:
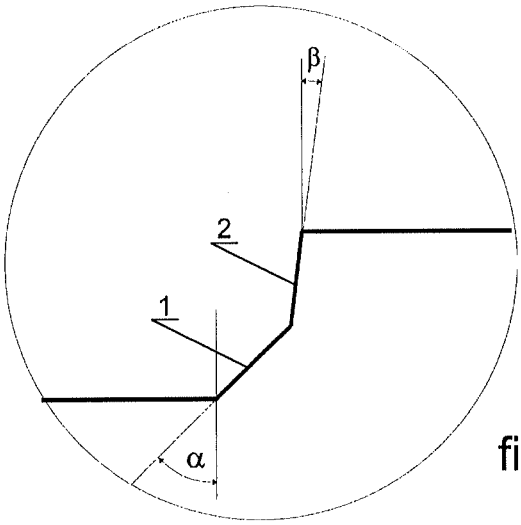
Figure 6:
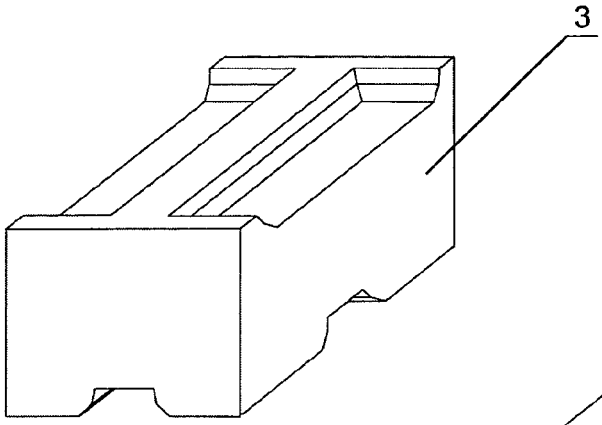
Figure 7:
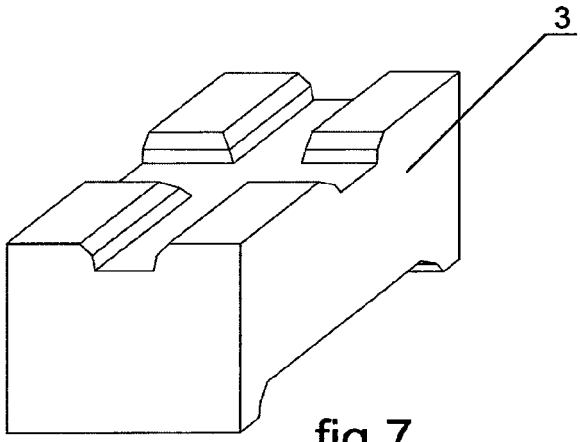
Figure 8:
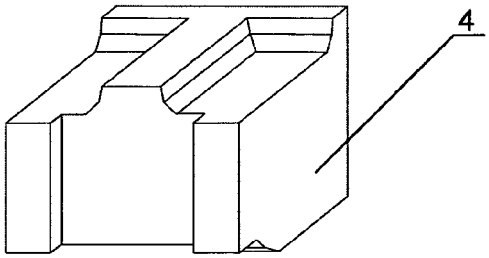
Figure 9:
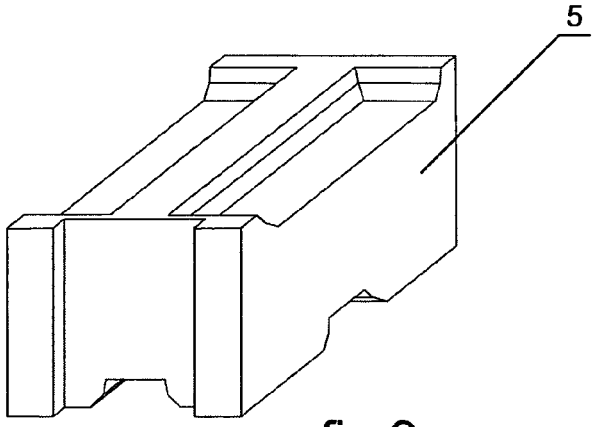
Figure 10:
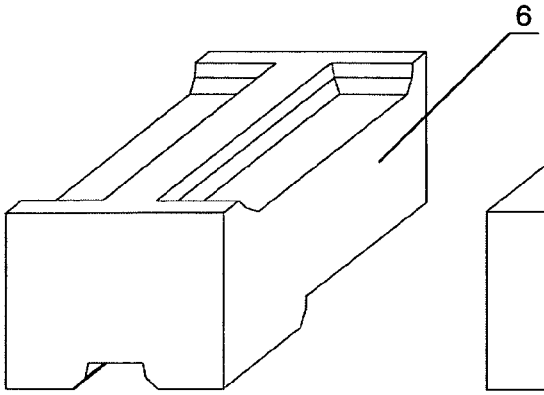
Figure 11:
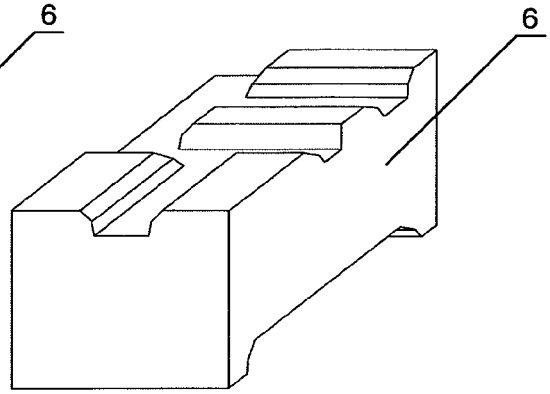
Figure 12:
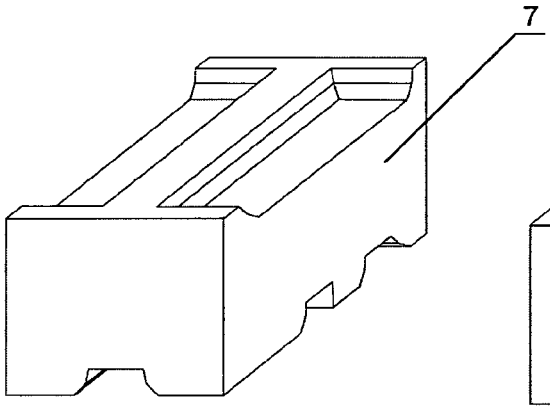
Figure 13:
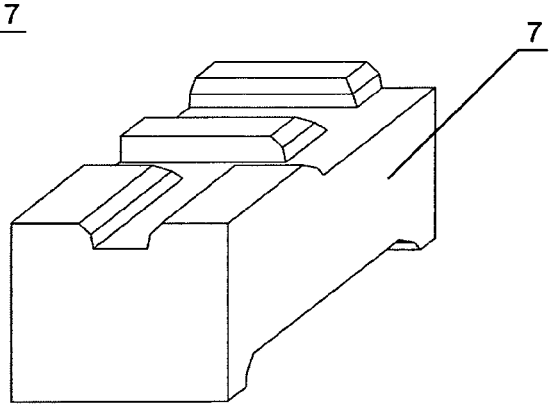
Figure 14:
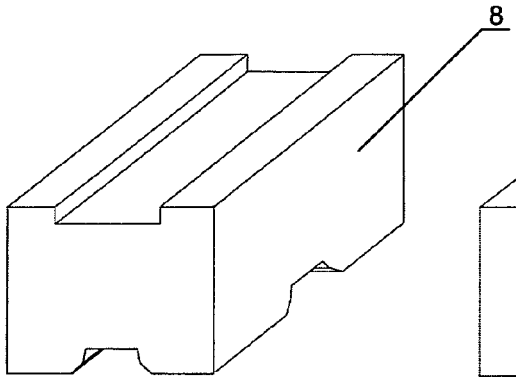
Figure 15:
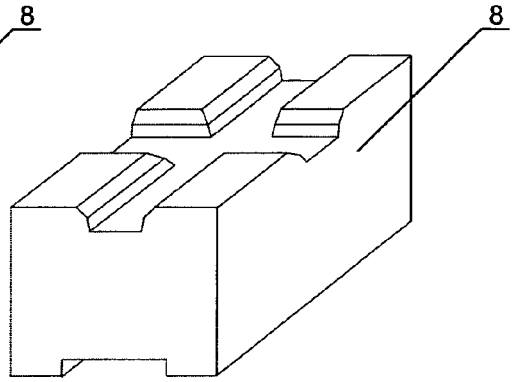
Figure 16:
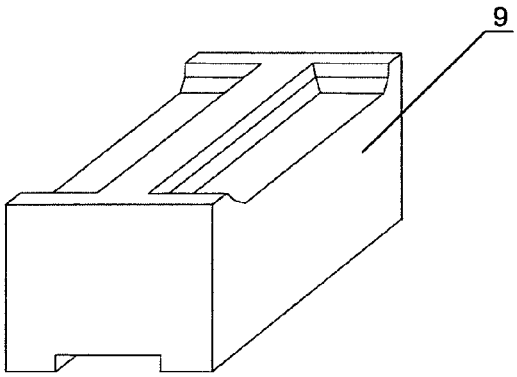
Figure 17:
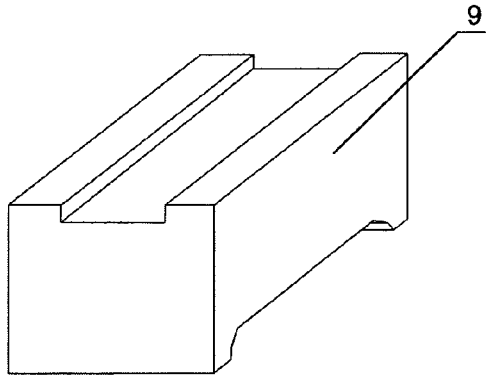
Figure 18:
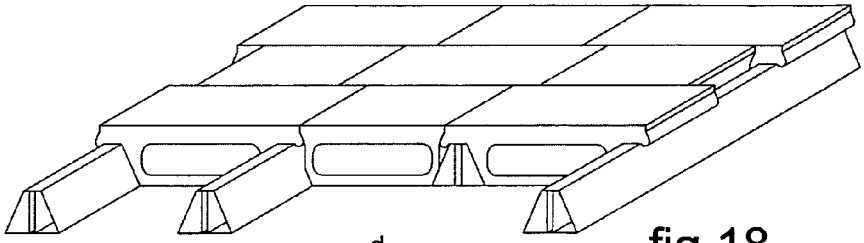
Figure 21:
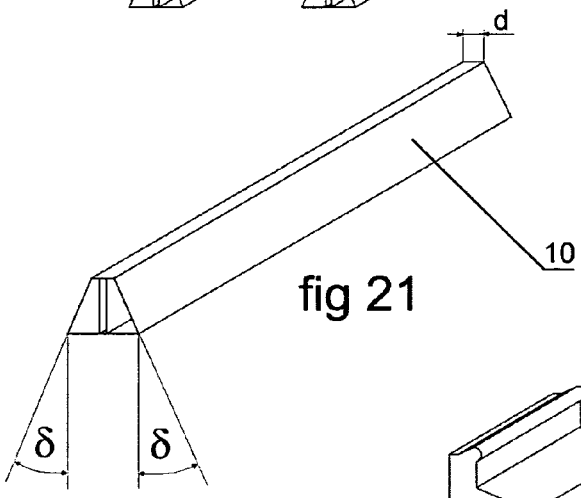
Figure 22:
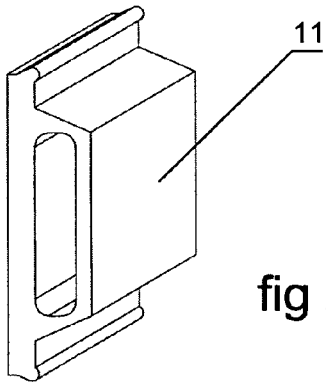
Figure 23:
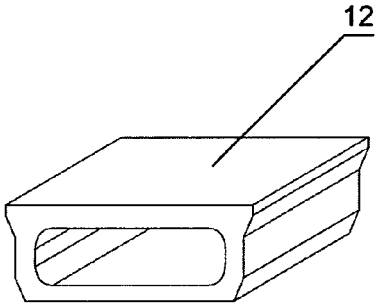
Figure 19:
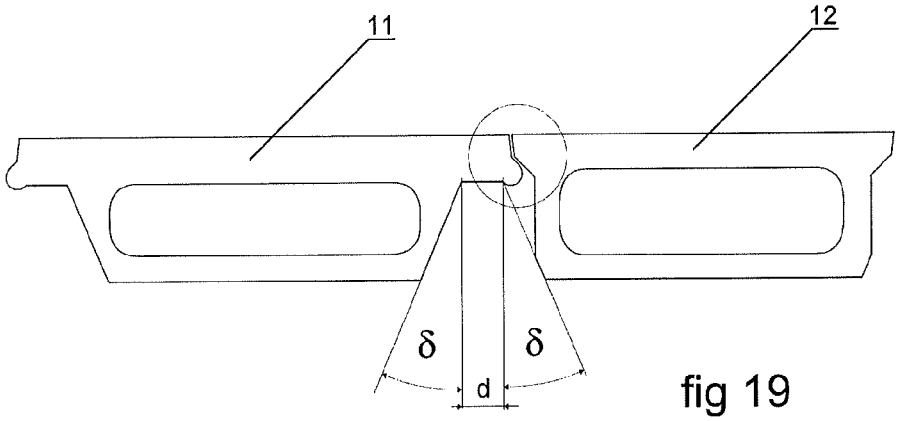
Figure 20:
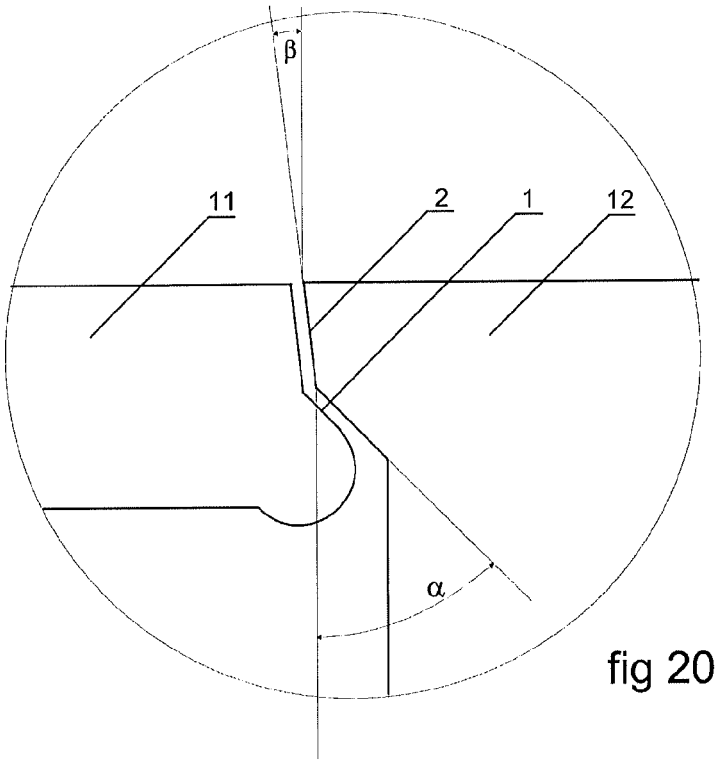
Figure 24:
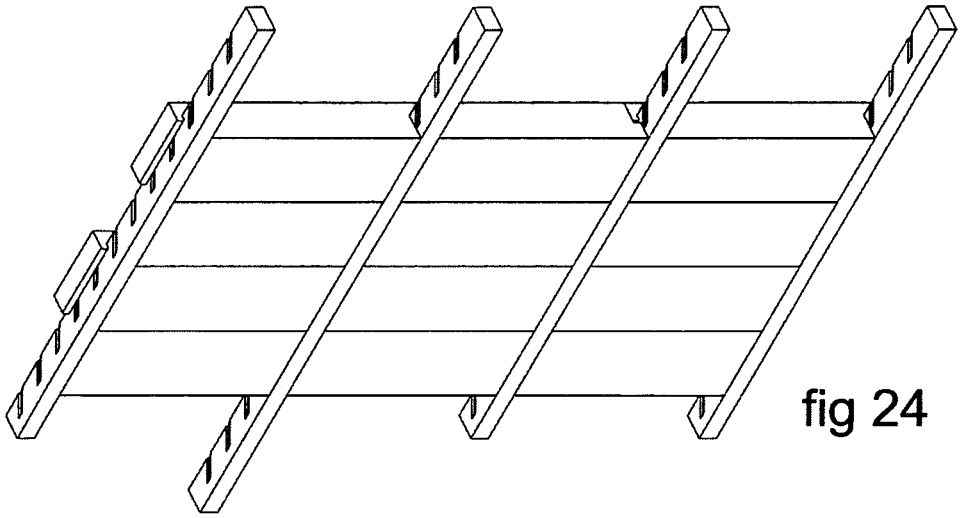
Figure 29:
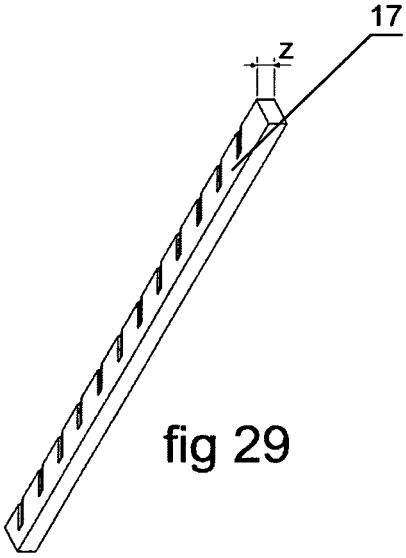
Figure 27:
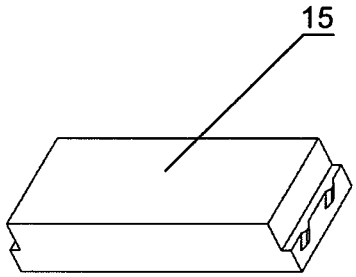
Figure 28:
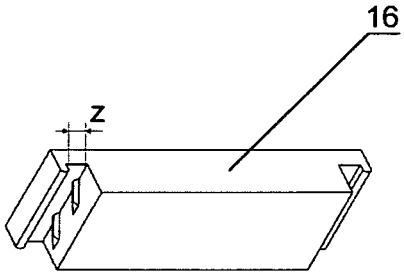
Figure 25:
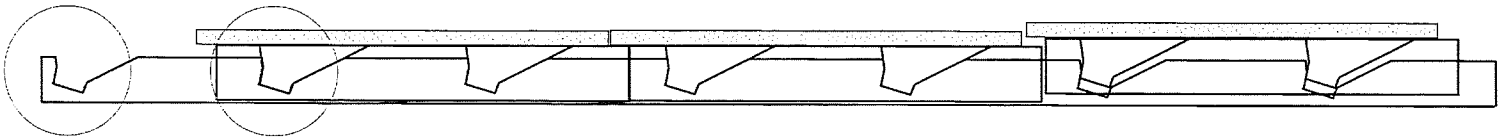
Figure 26:
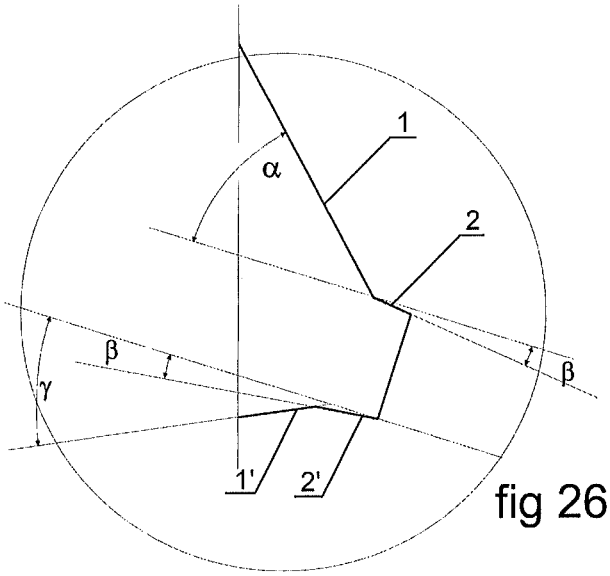

FIG. 1—shows an axonometric projection showing the connection of several wall construction elements with self-tightening surfaces, FIG. 2—projection of several connected wall construction elements, FIG. 3—projection of the shorter side of the wall construction element, FIG. 4—projection of the longer side of the wall construction element, FIG. 5—magnification of the marked fragments from FIGS. 2, 3 and 4 showing the self-tightening and guiding surfaces of the wall construction element, FIG. 6—axonometric projection of the basic wall construction element with upper surface, FIG. 7—axonometric projection of the basic wall construction element with lower surface, FIG. 8—axonometric projection of the half near-frame wall construction element with upper surface, FIG. 9—axonometric projection of the near-frame wall construction element with upper surface, FIG. 10—axonometric projection of the left corner wall construction element with upper surface, FIG. 11—axonometric projection of the left corner wall construction element with lower surface, FIG. 12—axonometric projection of the right corner wall construction element with upper surface, FIG. 13—axonometric projection of the right corner wall construction element with lower surface, FIG. 14—axonometric projection of the under-frame wall construction element with upper surface, FIG. 15—axonometric projection of the under-frame wall construction element with lower surface, FIG. 16—axonometric projection of the over-frame wall construction element with upper surface, FIG. 17—axonometric projection of the over-frame wall construction element with lower surface, FIG. 18—axonometric projection showing the connection of several ceiling construction elements, FIG. 19—projection of connected basic and supplementary ceiling construction elements, FIG. 20—magnification of the marked fragment from FIG. 19 showing the self-tightening and guiding surfaces of basic and supplementary ceiling construction elements, FIG. 21—axonometric projection of ceiling beam with upper and side surfaces, FIG. 22—axonometric projection of the basic ceiling construction element with lower and side surfaces, FIG. 23—axonometric projection of the supplementary ceiling construction element with upper and side surfaces, FIG. 24—axonometric projection showing the connection of several roof construction elements, FIG. 25—projection of connected roof construction elements with self-tightening surfaces, FIG. 26—magnification of the marked fragment from FIG. 25 showing the self-tightening and guiding surfaces of the roof construction element, FIG. 27—axonometric projection of the basic roof construction element with upper surface, FIG. 28—axonometric projection of the supplementary roof construction element with lower surface, FIG. 29—axonometric projection of the roof rafter beam with lower surface, FIG. 30—representation of forces occurring at connection of wall construction elements, FIG. 31—representation of forces occurring at the disconnection of wall construction elements.

An example wall module consists of three wall construction elements. The wall construction elements (3, 4, 5, 6, 7, 8, 9) possess recesses and protrusions located on the upper and lower surfaces forming self-tightening connections. The system of recesses and protrusions on the lower surface is shifted by half the length of the construction element in relation to the system of recesses and protrusions on the upper surface.

According to the invention, in the system the wall element is a construction element with an outline in the shape of a rectangular prism, upon which protrusions and recesses are located on the upper and lower surfaces.

The lateral guiding (1) and self-tightening (2) contact surfaces of the protrusions and recesses are inclined at specific angles $\alpha$ and $\beta$. The cross-section of protrusions and recesses has a shape of two trapezoids with a common base lying one on top of the other. The sides of the lower trapezoid are inclined at angle $\alpha$, which is determined by the perpendicular to the lower protrusion surface and the guiding surface (1), and the sides of the upper trapezoid are inclined at an angle of $\beta$, which is determined by the perpendicular to the upper protrusion surface and the self-tightening surface (2).

The basic wall construction element (3) presented in FIGS. 6, 7 has a longitudinal protrusion on its upper surface along the element's longitudinal axis with a cross-section of two trapezoids with a common base lying one on top of the other, and two transverse protrusions situated along the outer edges of the shorter side. The two transverse protrusions have a width equal to half the width of the lengthwise protrusion and a cross-section of two trapezoids with a common base with one lying on top of the other only from the internal side of the element. The longer trapezoid base comprises about ⅓ of the width of the entire wall construction element.

On the lower surface, this element has recesses along its longitudinal and transverse axes with cross-sections of two trapezoids with a common base with one lying on top of the other.

Protrusions and recesses on the lower surface do not correspond to the corresponding protrusions and recesses on the upper surface of the same element.

The condition making it possible to form a wall is that the protrusions and recesses on the lower surface are shifted by half the length of the construction element relative to the system of protrusions and recesses on the upper surface.

The basic element presented in FIGS. 6, 7 is not a universal element by means of which complete building walls can be made. Special modifications of this element shown as further elements of the system are needed for this purpose, and they have been presented on successive drawings.

Other wall construction elements are the half near-frame element (4) shown on FIG. 8 and the near-frame element (5) shown on FIG. 9. They are different from the basic wall construction element (3) by the shape of one of the side walls, which possesses a rectangular recess situated centrally. The width of this recess is greater than the longer trapezoid base.

Other wall construction elements are construction elements constituting the left (6) and right (7) corner wall elements (7) presented on FIGS. 10 and 11 and FIGS. 12 and 13, respectively. In this element, a protrusion with a cross-section of two trapezoids with a common base with one lying on top of the other is situated on the upper surface along with two transverse protrusions situated along the external edges of the shorter side, which are identical to those on the basic wall construction element.

On the lower surface, this element has recesses with cross-sections of two trapezoids with a common base with one lying on top of the other. One is situated at half of the element's length along the longitudinal axis, two others are situated transverse to the longer side of this element and one more is located along the longer side at half of the element's length.

Further wall construction elements are construction elements constituting the under-frame wall element (8) shown in FIGS. 14 and 15 as well as the over-frame wall element (9) shown in FIGS. 16 and 17. They are different from the basic wall construction element by the shape of one of the upper or lower walls, which possesses a rectangular recess situated centrally. The width of this recess is greater than the width of the longer trapezoid base.

The cross-sections of protrusions found on system elements, according to the invention, are comprised of two trapezoids adhering to each other. The trapezoid with the lesser angle of inclination in the connection of mutual elements functions as a part of a wedge, and in relation to this, physical relationships similar to those of a wedge occur.

An exemplary ceiling module is presented in FIGS. 18-23. It consists of a basic ceiling construction element (FIG. 22) and a supplementary ceiling construction element (FIG. 23) as well as ceiling beams (FIG. 21).

The basic (11) and supplementary (12) ceiling construction elements possess guiding (1) and self-tightening (2) lateral contact surfaces, inclined at angles $\alpha$ and $\beta$, upon which self-tightening connections are formed. These surfaces are found on protrusions situated near the upper edge of neighbouring basic and supplementary ceiling elements. The lateral self-tightening contact surface and the perpendicular to the upper surface of the ceiling element form angle $\beta$, and the upper lateral guiding contact surface forms angle α with the perpendicular to the lower surface of the ceiling element.

As shown in FIG. 20, the basic (11) ceiling construction element, in the upper part of protrusions situated near the upper edges has a cross-section of two trapezoids with a common base lying one on top of the other, possessing short sides and a long base.

In the lower part of the protrusions visible in FIGS. 18 and 19, the basic ceiling elements (11) possess a rounded edge transitioning into the lower edge with protrusion length d parallel to the upper surface. The length of the lower edge d of the protrusions corresponds to the upper width of the ceiling beam (10). The lower part of the basic ceiling element (11) shown on FIG. 19 possesses a protrusion with a trapezoidal cross-section, inside of which a hollow oval recess can be found.

The supplementary ceiling construction element (12) according to FIGS. 19, 20 and 23 has a cross-section of two trapezoids with a common base with one lying on top of the other, with short sides and a wide and long base, in the upper part of the protrusions situated near the upper edges.

Below the trapezoidal protrusions, the side walls of the supplementary ceiling element (12) are perpendicular to the upper and lower surfaces of this element for about ⅓ of their height and are diagonal near the lower edge. Inside of the supplementary ceiling construction element (12) a hollow oval recess can be found.

Ceiling beam (10) shown in FIG. 21 has a trapezoidal cross-section, of which the upper base d corresponds to the length of the lower edge d of the protrusions from the basic ceiling construction element (11).

Basic (11) and supplementary (12) ceiling construction elements are placed alternately. In one row, the placement is started from the basic ceiling construction element (11), and in the next, the row is started from the supplementary ceiling construction element (12).

An example roof module is presented in FIGS. 24-29. The roof module consists of the basic roof construction element (15) presented in FIG. 27 and the supplementary roof element (16) shown in FIG. 28, as well as the roof rafter beam (17) shown in FIG. 29. The basic and supplementary roof elements have protrusions located on their side surfaces, and the roof rafter beam has recesses on its entire length. A self-tightening connection is formed on the self-tightening contact surfaces (2) of recesses and protrusions. Protrusions on the side surface of the basic roof construction element and the roof supplementary element constitute a mutual fitting of recesses on the roof rafter beam. Furthermore, recesses and protrusions are situated at an acute angle relative to the perpendicular to the roof surface.

The guiding and self-tightening lateral contact surfaces of protrusions and recesses are inclined at specific angles α and β, and the self-tightening part of protrusions and recesses has side walls that are inclined at an angle of β relative to the perpendicular to the lower surface of the protrusion and recess, and the guiding surfaces of recesses and protrusions have side walls inclined at acute angles α to the perpendicular of the lower surface of the protrusion and recess. Furthermore, protrusions and recesses have guiding surfaces inclined at acute angle γ. The side walls of the protrusion and recess in the self-tightening and guiding part have different lengths.

The basic roof construction element (15) shown in FIG. 27 has cuboidal protrusions on its side walls up to half of its height, on which protrusions having a guiding and self-tightening part are placed at an angle to the upper edge.

The supplementary roof element (16) according to FIG. 28 has an L-shaped extension for placing this element on the roof beam (17) along its upper surface. The length of extension z corresponds to the upper width of the roof rafter beam (17). On the side walls of the supplementary element (16), under the L-shaped extension, protrusions with guiding and self-tightening parts are placed at an angle to the upper edge.

The roof rafter beam (17) shown in FIG. 29 is a rectangular prism, in which diagonal recesses having a guiding (1) and self-tightening (2) part have been added.

Basic (15) and supplementary (16) roof construction elements are alternately placed. In one row, the placement of rows is started from the basic roof construction element (15), and in the next, the row is started from the supplementary roof construction element (16).

FIGS. 30 and 31 present the distribution of forces occurring at the connection and disconnection of wall construction elements on the contact surfaces of protrusions and recesses.

FIG. 30 presents the cooperation of protruding parts being wedge sectors (hereinafter referred to as "wedge") with an angle of convergence of 2α, driven in with force Q occurring during assembly of elements of the objective system. Based on the figure presented on the magnified fragment of FIG. 30, the pressures applied to the walls of individual elements can be calculated. Between the lateral surfaces of the "wedge" and the surfaces that the "wedge" is driven between, pressures equal to normal reactions N, and forces of friction T will occur. Due to the symmetry of the "wedge," the pressures and forces of friction will be equal to one another.

Considering the case where the "wedge" is driven in during the connection of elements, the forces of friction will act opposite to the vectors of velocity lying on the side surfaces of the "wedge." By calculating the equilibrium of the system of forces, i.e., by projecting all forces on the vertical direction of the y axis, the following is obtained:

$$2T\cos\alpha+2N\sin\alpha-Q=0$$

due to the fact that T=μN, where:

μ—is the coefficient of friction,

T—force of friction,

N—force of pressure on the surface over which the considered element is shifting, ergo:

$$2\mu N\cos\alpha+2N\sin\alpha=Q$$

hence the pressures exerted by the "wedge" on the walls of the material:

$$N=\frac{Q}{2(\mu\cos\alpha+\sin\alpha)}.$$

The force P necessary to remove a "wedge" that had been driven in earlier with a force of Q, shown in FIG. 31, is calculated as follows. In this case, the reaction of force P will be directed downwards, and the force of friction T will also change its reaction to the opposite. Let us therefore project all forces on the vertical direction of the y axis:

$$P+2N\sin\alpha-2T\cos\alpha=0$$

due to the fact that T=μN, ergo:

$$P=2\mu N\cos\alpha-2N\sin\alpha$$

$$P=N(\mu\cos\alpha-\sin\alpha)$$

hence, after substituting the N value previously calculated, the force P necessary for removing a "wedge" driven in earlier with a force of Q is equal to:

$$P = \frac{Q(\mu\cos\alpha - \sin\alpha)}{\mu\cos\alpha + \sin\alpha}.$$

Analyzing the Above:

If the forces of friction and the forces of pressure are in equilibrium, the "wedge" will be able to slide out freely, therefore:

$$2\mu N\cos\alpha - 2N\sin\alpha = 0$$

$$\mu\cos\alpha = \sin\alpha\mu = tg\alpha$$

$$\alpha = \rho$$

where ρ is the angle of friction.

If α<ρ then a force of P would be necessary to pull out the "wedge" driven into the material. If this condition is fulfilled, a self-locking system is in place. The connection of two system elements fulfilling the above condition can be recognized as a persistent quick release connection.

Furthermore, according to the scope of the invention, the system of construction elements is meant for raising low structures and also for completing walls in buildings with a skeletal structure.

The system described in the patent application also finds an application as blocks for raising miniature constructions possessing the same properties and shapes and differing from the above only in terms of the size and the material they are made from.

However, the system of construction elements for the dry construction of buildings, according to the invention, has been specified by thirteen patent claims, presented in the form of specific examples of execution in the invention description, and shown in drawings. It is obvious to an expert in the field that the data on systems of construction elements contained within the descriptive application cannot be interpreted as limiting the inventive idea to only this data.

The invention claimed is:

1. A system of construction elements for the dry construction of structures possessing shaped protrusions and recesses for mutual connection during assembly, comprising: a plurality of construction element modules for raising walls, a ceiling, a roof, or any combination thereof, wherein each module comprises two construction elements with adjacent sides connected by a third construction element, creating a self-tightening connection, wherein the shaped protrusions and recesses of the construction elements have two lateral contact surfaces comprising a guiding surface and a self-tightening surface, inclined at specific respective different angles α and β, and that these angles are determined, respectively, between the perpendicular to an upper or a lower protrusion surface and the guiding or self-tightening surface, wherein the angle of inclination of the angle α is within a range of 40°-50°, and the angle β is within a range of 6°-12°, wherein the construction elements include wall construction elements that have the protrusions and the recesses located on the upper and lower surfaces forming a self-tightening connection when connected together such that the guiding surfaces of the connected protrusions and recesses are in abutting contact with each other and such that the self-tightening surfaces of the connected protrusions and recesses are in abutting contact with each other, and whereby a system of the protrusions and recesses of the lower surfaces of a first row of the wall construction elements connected to the respective recesses and protrusions of the upper surfaces of a second row of the wall construction elements is shifted by half of the length of a wall construction element with respect to the second row of the wall construction elements.

2. The system according to claim 1, wherein the shape of the construction elements unequivocally ensures a mutual connection between at least three construction elements that allows for the self-caulking of connections between the at least three construction elements due to the presence of resultant stresses on the guide surfaces and self-tightening surfaces between neighboring construction elements without mortar or fasteners.

3. The system according to claim 1, wherein each construction element has a longitudinal protrusion on its upper surface along the element's longitudinal axis, which longitudinal protrusion extends between two transverse protrusions situated along the outer edges across the width of the upper surface of the construction element.

4. The system according to claim 3, wherein the two transverse protrusions have a width equal to half a width of the longitudinal protrusion.

5. The system according to claim 1, wherein the modules include a plurality of wall modules.

6. The system according to claim 1, wherein the angle of inclination of the angle α is within a range of 45°-50°, and the angle β is within a range of 7°-12°.

7. A system of construction elements for the dry construction of structures possessing shaped protrusions for mutual connection during assembly, comprising: a plurality of construction element modules for raising walls, a ceiling, a roof, or any combination thereof, wherein each module comprises two construction elements with adjacent sides connected by a third construction element, creating a self-tightening connection, wherein the shaped protrusions of the construction elements have two lateral contact surfaces comprising a guiding surface and a self-tightening surface, inclined at specific respective different angles α and β, and that these angles are determined, respectively, between the perpendicular to an upper or a lower protrusion surface and the guiding or self-tightening surface, wherein the angle of inclination of the angle α is within a range of 40°-50°, and the angle β is within a range of 6°-12°, wherein the construction elements include wall construction elements that have protrusions and recesses located on the upper and lower surfaces forming a self-tightening connection when connected together, and whereby a system of protrusions and recesses of the lower surfaces of a first row of the wall construction elements connected to the respective recesses and protrusions of the upper surfaces of a second row of the wall construction elements is shifted by half of the length of a wall construction element with respect to the second row of the wall construction elements, wherein the modules include ceiling modules, wherein each ceiling module contains a basic ceiling construction element and a supplementary ceiling construction element as well as a ceiling beam construction element, whereby the basic ceiling construction element and the supplementary ceiling construction element have guiding and self-tightening lateral contact surfaces inclined at the specific angles α and β, upon which surfaces self-tightening connections are formed, with these surfaces being located at protrusions situated near the upper edge of the neighbouring basic ceiling construction element and supplementary ceiling construction elements, whereby the self-tightening lateral contact surface forms the angle β with the perpendicular to the upper surface of the ceiling construction element, and the guiding lateral contact surface forms the angle α with the perpendicular to the lower surface of the ceiling construction element, wherein at least three cooperating elements, which unequivocally ensures a mutual connection that allows for the self-caulking of connections due to the presence of resultant stresses between neighbouring elements.

8. The system according to claim 7, wherein the ceiling modules are connected such that the basic and the supplementary ceiling construction elements are alternately placed along its longitudinal axis.

9. A system of construction elements for the dry construction of structures possessing shaped protrusions for mutual connection during assembly, comprising: a plurality of construction element modules for raising a roof, and that each roof module comprises two construction elements with adjacent sides corresponding to a basic roof construction element and a supplementary roof construction element, connected by a third construction element corresponding to a roof rafter beam construction element, creating a self-tightening connection, wherein the shaped protrusions of the construction elements have two lateral contact surfaces comprising a guiding surface and a self-tightening surface, inclined at the specific angles α and β, wherein these angles are determined, respectively, between the perpendicular to the upper or lower protrusion surface and the guiding or self-tightening surface, whereby the basic and supplementary roof construction elements possess protrusions positioned on lateral surfaces, and the roof rafter beam construction element has recesses throughout its entire length, and the guiding and self-tightening contact surfaces of the protrusions and recesses create self-tightening connections, whereby the protrusions on the lateral surface of the basic roof construction element and the supplementary roof construction element constitute a mutual match to the recesses on the roof rafter beam construction element, and furthermore, the protrusions and recesses are situated at an acute angle relative to the perpendicular to the roof surface.

10. The system according to claim 9, wherein the guiding and self-tightening lateral contact surfaces of the protrusions and recesses are inclined at the specific angles α and β, in which the self-tightening surface of protrusions and recesses has lateral walls inclined at the angle of β relative to the perpendicular to the lower surface of the protrusion and recess, and the guiding surfaces of protrusions and recesses have lateral walls inclined at the angles α that are acute to the perpendicular to the lower surface of the protrusion and recess, and furthermore protrusions and recesses have guiding surfaces inclined at acute angle γ, and also the lateral walls of the protrusions and recesses in the self-tightening and guiding surfaces have different lengths.

11. The system according to claim 9, wherein the basic and supplementary roof construction elements are placed alternately.

* * * * *